US006812678B1

(12) United States Patent
Brohlin

(10) Patent No.: US 6,812,678 B1
(45) Date of Patent: Nov. 2, 2004

(54) VOLTAGE INDEPENDENT CLASS A OUTPUT STAGE SPEEDUP CIRCUIT

(75) Inventor: Paul L. Brohlin, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 680 days.

(21) Appl. No.: 09/684,138

(22) Filed: Oct. 10, 2000

Related U.S. Application Data

(60) Provisional application No. 60/166,545, filed on Nov. 18, 1999.

(51) Int. Cl.[7] ..... G05F 1/56
(52) U.S. Cl. ..... 323/280; 323/273
(58) Field of Search ..... 323/273, 280, 323/282, 289

(56) References Cited

U.S. PATENT DOCUMENTS 5,126,652 A * 6/1992 Carlin ..... 323/282
5,548,205 A * 8/1996 Monticelli ..... 323/280
5,648,718 A * 7/1997 Edwards ..... 323/280
5,864,227 A * 1/1999 Borden et al. ..... 323/280
5,867,015 A * 2/1999 Corsi et al. ..... 323/316
5,982,226 A * 11/1999 Rincon-Mora ..... 323/280
6,046,577 A * 4/2000 Rincon-Mora ..... 323/282

* cited by examiner

*Primary Examiner*—Jeffrey Sterrett
(74) *Attorney, Agent, or Firm*—Alan K. Stewart; W. James Brady, III; Frederick J. Telecky, Jr.

(57) ABSTRACT

A low drop-out voltage regulator circuit includes: a MOS pass through transistor 12; a resistor feedback circuit 18 and 20 coupled to the MOS pass through transistor 12; an amplifier 16 having an input coupled to the resistor feedback circuit 18 and 20; a Class A output stage 22 coupled between an output of the amplifier 16 and a gate of the MOS pass through transistor 12; and a speedup circuit 48 coupled between the output of the amplifier and the gate of the MOS pass through transistor.

5 Claims, 1 Drawing Sheet

VOLTAGE INDEPENDENT CLASS A OUTPUT STAGE SPEEDUP CIRCUIT

This application claims priority under 35 USC § 119 (e)(1) of provisional application Ser. No. 60/166,545, filed Nov. 18, 1999.

FIELD OF THE INVENTION

This invention generally relates to electronic systems and in particular it relates to voltage regulators.

BACKGROUND OF THE INVENTION

Many electronic circuits use amplifiers to manipulate various signals within the circuit. The output of the amplifier may be connected to provide an output voltage to a load circuit. The design of the output stage may affect various operating aspects of the amplifier. For example, some amplifiers can deliver a high output current to the load. Other amplifiers can produce an output voltage swing that is approximately equal to the magnitude of the power supply for the amplifier circuit. Some amplifiers must provide an output that has a low crossover distortion. Yet other amplifiers are required to maintain gain and stability at relatively high frequencies. Each of these requirements places constraints upon the design of the output stage.

During operation, an amplifier circuit consumes current from a power supply. A portion of this current, known as the quiescent current, is used to bias the internal circuitry of the amplifier. Trends in IC design (especially battery-powered applications) are requiring supply currents (quiescent currents) to decrease. In amplifiers, the large signal transient response or slew rate is directly related to the quiescent current in the output stage.

SUMMARY OF THE INVENTION

Generally, and in one form of the invention, the low dropout voltage regulator circuit includes: a MOS pass through transistor;

- a resistor feedback circuit coupled to the MOS pass through transistor; an amplifier having an input coupled to the resistor feedback circuit; a Class A output stage coupled between an output of the amplifier and a gate of the MOS pass through transistor; and
- a speedup circuit coupled between the output of the amplifier and the gate of the MOS pass through transistor.

DETAILED DESCRIPTION OF PREFERRED EMBODIMENTS

Figure 1:
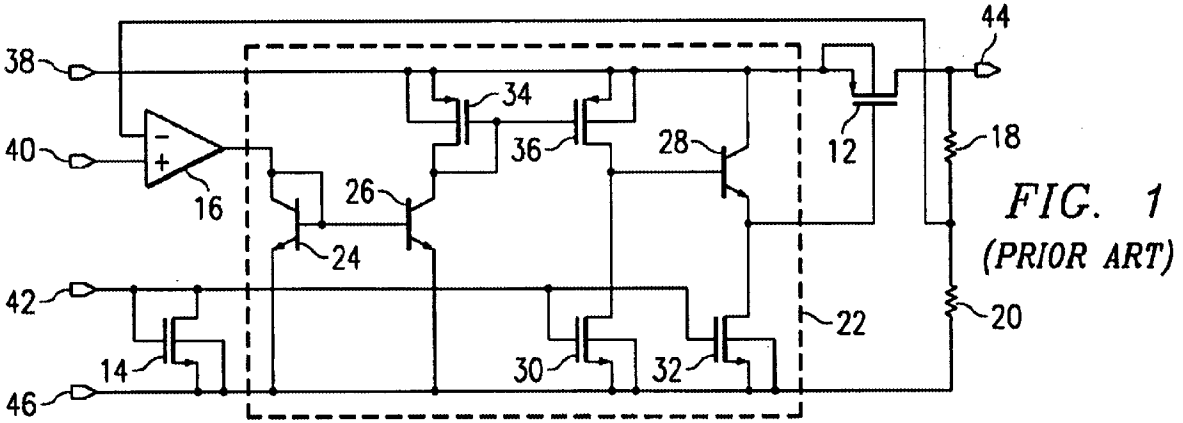
FIG. 1 (PRIOR ART)
FIG. 1 is a schematic circuit diagram of a prior art low drop-out voltage regulator with PMOS pass element.

Referring to FIG. 1, a circuit diagram of a prior art low drop-out (LDO) voltage regulator with PMOS pass element is illustrated. The circuit of FIG. 1 includes PMOS pass device 12 (PMOS transistor); PMOS transistor 14; amplifier 16; resistors 18 and 20; output stage 22 which includes bipolar transistors 24, 26, and 28, NMOS transistors 30 and 32, PMOS transistors 34 and 36; input voltage node 38; reference voltage node 40; current reference node 42; output node 44; and ground node 46. The amplifier output stage 22 is Class A. PMOS pass transistor 12 is a large device and has a large gate capacitance. The emitter follower 28 can turn off transistor 12 very quickly because of the beta multiplication of its base current. However, the turn on for transistor 12 is slow because of the small quiescent current of current sink transistor 32.

An increasing load transient operates as follows. When the amplifier 16 is "in balance", the current in transistor 24 is equal to a linear ratio of the pull down current in transistor 30. When the output load is increased at output node 44, the output voltage at node 44 will fall. In turn, amplifier 16 decreases the current through transistor 24 allowing the current sink transistor 32 to pull the gate of transistor 12 down. When the output voltage at node 44 increases to the regulation voltage, the amplifier 16 increases the current in transistor 24 to the "balance current". As discussed above, the sink current in transistor 32 and the gate capacitance of transistor 12 determine the slew rate. In efforts to have a small supply current, the sink current is very small. This causes a slow transient response.

Figure 2:
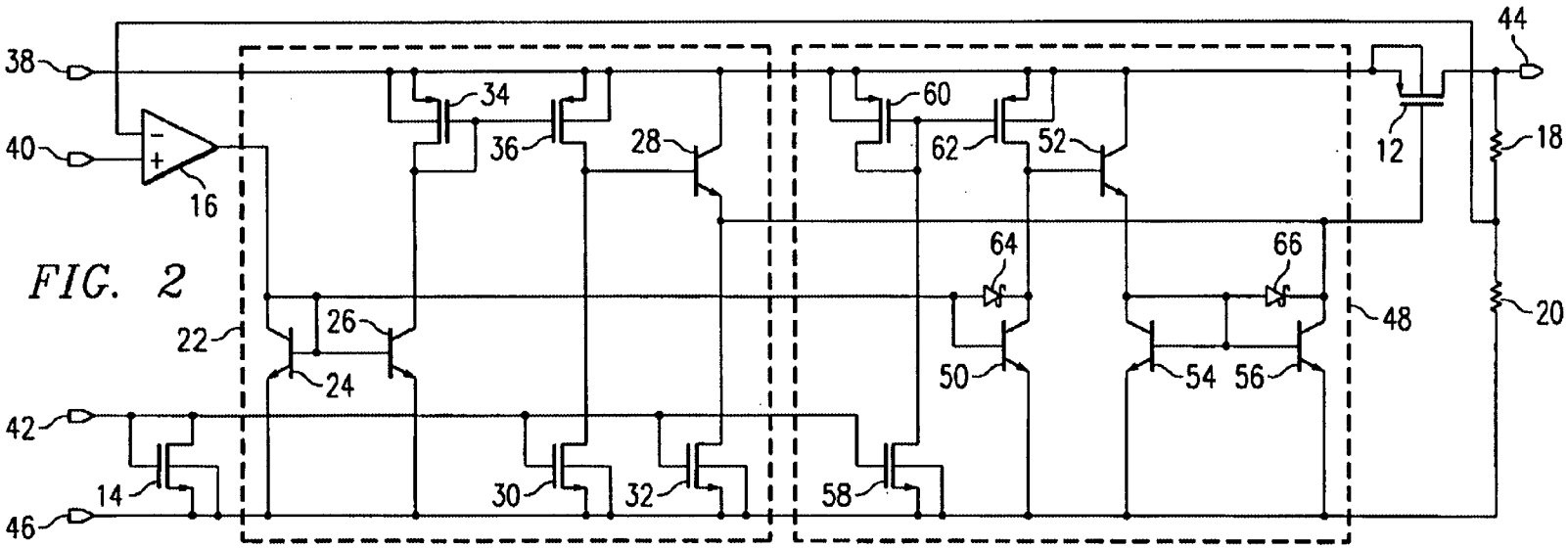
FIG. 2 is a schematic circuit diagram of a preferred embodiment output stage speedup circuit in a low drop-out voltage regulator with PMOS pass element.

Referring to FIG. 2, a circuit diagram of a preferred embodiment output stage speedup circuit in a low drop-out (LDO) voltage regulator with PMOS pass element is illustrated. The circuit of FIG. 2 includes PMOS pass device 12 (PMOS transistor); PMOS transistor 14; amplifier 16; resistors 18 and 20; output stage 22 which includes bipolar transistors 24, 26, and 28, NMOS transistors 30 and 32, PMOS transistors 34 and 36; input voltage node 38; reference voltage node 40; current reference node 42; output node 44; ground node 46; and speedup circuit 48 which includes bipolar transistors 50, 52, 54, and 56, NMOS transistor 58, PMOS transistors 60 and 62, and Schottky diodes 64 and 66.

Speedup circuit 48 operates as follows. When amplifier 16 is "in balance", the current in transistor 50 is much larger than the reference current in transistor 62. This disables the speedup circuit 48. During a large signal transient, the amplifier 16 decreases the current in transistor 50 to near zero. The reference current in transistor 62 will then flow into the base of transistor 52, turning on the speedup circuit 48. The reference current in transistor 60 is then increased (by current mirror ratio, beta multiplication, etc.) and sunk out of the gate of transistor 12. This greatly increases the slew rate. As the output voltage at node 44 increases towards the regulation voltage, the amplifier 16 increases the current in transistor 50 and disables the speedup circuit 48.

The speedup circuit 48 provides several advantages. The Class A output stage 22 is sped up with very little increase in supply current. The speedup is very controlled by having a set speedup supplement. Assuming the reference current is supply voltage independent, the speedup current will be supply voltage independent. The effects of the speedup circuit 48 will have consistent transient response over the supply range allowing easy stabilization of the nonlinear effect of the speedup. The output speedup circuit 48 can swing to the supply rail allowing full transient response to the supply rail.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed is:

1. A low drop-out voltage regulator circuit comprising:

a MOS pass through transistor;

a resistor feedback circuit coupled to the MOS pass through transistor;

an amplifier having an input coupled to the resistor feedback circuit;

a Class A output stage coupled between an output of the amplifier and a gate of the MOS pass through transistor; and a speedup circuit coupled between the output of the ampililier and the gate of the MOS pass through transistor.

2. The circuit of claim 1 wherein the speedup circuit comprises:

a first bipolar transistor coupled to the gate of the MOS pass through transistor;

a second bipolar transistor having a base coupled to the base of the first bipolar transistor, and a collector of the second bipolar transistor coupled to the base of the second bipolar transistor;

a third bipolar transistor having an emitter coupled to the collector of the second bipolar transistor; and a fourth bipolar transistor having a collector coupled to a base of the third bipolar transistor, and a base of the fourth bipolar transistor is coupled to the output of the amplifier.

3. The circuit of claim 2 further comprising a first MOS transistor coupled to the collector of the fourth bipolar transistor.

4. The circuit of claim 3 further comprising a second MOS transistor having a gate coupled to a gate of the first MOS transistor, and having a drain coupled to the gate of the second MOS transistor.

5. The circuit of claim 4 further comprising a third MOS transistor having a drain coupled to the drain of the second MOS transistor, and having a gate coupled to a reference node.

* * * * *